US011473887B2

(12) United States Patent
Swanson et al.

(10) Patent No.: US 11,473,887 B2
(45) Date of Patent: Oct. 18, 2022

(54) CASTABLE FRANGIBLE PROJECTILE

(71) Applicant: Rocky Mountain Scientific Laboratory, LLC, Littleton, CO (US)

(72) Inventors: Travis Swanson, Littleton, CO (US); Jon Kosak, Littleton, CO (US); Robert R. Nellums, Spring Hill, TN (US); Kristina Wikstrom, Littleton, CO (US)

(73) Assignee: Rocky Mountain Scientific Laboratory, LLC, Littleton, CO (US)

( * ) Notice: Subject to any disclaimer, the term of this patent is extended or adjusted under 35 U.S.C. 154(b) by 0 days.

(21) Appl. No.: 17/382,998

(22) Filed: Jul. 22, 2021

(65) Prior Publication Data

US 2021/0348899 A1 Nov. 11, 2021

Related U.S. Application Data

(62) Division of application No. 16/872,002, filed on May 11, 2020, now Pat. No. 11,105,597.

(51) Int. Cl.

| | |
|---|---|
| ***F42B 12/36*** | (2006.01) |
| ***F42B 5/28*** | (2006.01) |
| ***F42B 33/02*** | (2006.01) |
| ***F42B 10/22*** | (2006.01) |
| ***F42B 12/76*** | (2006.01) |
| *F42B 7/02* | (2006.01) |

(52) U.S. Cl.

CPC ..... *F42B 12/367* (2013.01); *F42B 5/28* (2013.01); *F42B 10/22* (2013.01); *F42B 12/76* (2013.01); *F42B 33/0214* (2013.01); *F42B 7/02* (2013.01)

(58) Field of Classification Search

CPC ..... F42B 12/367; F42B 12/22; F42B 8/14; F42B 12/76; F42B 12/72; F42B 12/74; F42B 12/78; F42B 30/00; F42B 30/02; F42B 30/08; F42B 12/36

USPC ..... 102/389, 491, 492, 493, 494, 495, 506, 102/501, 517

See application file for complete search history.

(56) References Cited

U.S. PATENT DOCUMENTS

| | | | |
|---|---|---|---|
| 4,958,572 | A | 9/1990 | Martel |
| 4,996,924 | A | 3/1991 | McClain |
| 5,078,054 | A | 1/1992 | Ashok |
| 5,133,261 | A | 7/1992 | Kelsey, Jr. |

(Continued)

FOREIGN PATENT DOCUMENTS

| | | |
|---|---|---|
| CA | 2329617 | 1/2000 |

OTHER PUBLICATIONS

U.S. Appl. No. 16/872,002 Non-Provisional Application, filed May 11, 2020, 63 pages.

(Continued)

*Primary Examiner* — Jonathan C Weber
(74) *Attorney, Agent, or Firm* — Adsero IP

(57) ABSTRACT

A novel castable frangible projectile and techniques for manufacturing such are provided. A cartridge system includes a case defining a volume, a propellant disposed in the volume of the case, and a projectile coupled to the case. The projectile includes a body disposed at least partially within the case and configured to enclose the propellant within the volume of the case. The body is formed of a castable eutectic mixture, the castable eutectic mixture configured to be melted and cast, wherein the body is configured to break into a plurality of fragments upon impact with a target.

4 Claims, 8 Drawing Sheets

1008

400

(56) References Cited

U.S. PATENT DOCUMENTS

| | | | | |
|---|---|---|---|---|
| 5,164,538 | A | 7/1992 | McClain, III | |
| 5,760,331 | A | 6/1998 | Lowden | |
| 5,877,437 | A | 3/1999 | Oltrogge | |
| 6,024,021 | A | 2/2000 | Schultz | |
| 6,149,705 | A | 11/2000 | Lowden | |
| 6,502,516 | B1 | 1/2003 | Kinchin | |
| 6,679,178 | B2 | 1/2004 | Mihaylov | |
| 8,028,626 | B2 * | 10/2011 | Hash | F42B 30/02 102/517 |
| 8,171,851 | B2 * | 5/2012 | Siddle | C22C 29/06 102/513 |
| 10,323,919 | B2 * | 6/2019 | Hash | F42B 30/02 |
| 11,105,597 | B1 | 8/2021 | Swanson et al. | |
| 11,150,063 | B1 | 10/2021 | Swanson et al. | |
| 2002/0134273 | A1 | 9/2002 | Mihaylov | |
| 2003/0192448 | A1 | 10/2003 | Leasure | |
| 2005/0268809 | A1 * | 12/2005 | Smith | F42B 12/72 102/517 |
| 2006/0288897 | A1 * | 12/2006 | Williams | F42B 12/22 102/364 |
| 2010/0083861 | A1 * | 4/2010 | Joys | F42B 12/74 102/506 |
| 2011/0162550 | A1 * | 7/2011 | Hash | F42B 30/02 419/10 |
| 2015/0330756 | A1 * | 11/2015 | Ward | B05D 1/36 102/501 |
| 2016/0258724 | A1 * | 9/2016 | Smith | F42B 10/42 |
| 2021/0217508 | A1 | 7/2021 | Swanson et al. | |
| 2021/0348898 | A1 | 11/2021 | Swanson et al. | |
| 2021/0348900 | A1 | 11/2021 | Swanson et al. | |
| 2022/0120541 | A1 | 4/2022 | Swanson et al. | |

OTHER PUBLICATIONS

U.S. Appl. No. 16/872,019 Non-Provisional Application, filed May 11, 2020, 65 pages.

U.S. Appl. No. 16/872,019 Notice of Allowance, dated Jun. 9, 2021, 53 pages.

U.S. Appl. No. 16/872,002 Notice of Allowance, dated Jun. 10, 2021, 53 pages.

U.S. Appl. No. 17/383,021 Notice of Allowance, dated Jun. 27, 2022, 27 pages.

* cited by examiner

200B

300B

CASTABLE FRANGIBLE PROJECTILE

CROSS-REFERENCE TO RELATED APPLICATIONS

This application is a divisional of U.S. application Ser. No. 16/872,002 filed on May 11, 2020, Swanson et al., and entitled "Castable Frangible Projectile", and may be related to U.S. patent application Ser. No. 16/872,019, filed May 11, 2020, by Swanson et al., and entitled "Enhanced Castable Frangible Breaching Round", the disclosure of which is incorporated herein by reference, in its entirety, for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to frangible projectiles and more specifically to a castable frangible projectile, and techniques for manufacturing castable frangible projectiles.

BACKGROUND

Frangible projectiles are of great interest to military, law-enforcement, and civilian personnel to reduce to potential dangers of ricochet or over-penetration. Typically, discrete particle breakup is encouraged by utilizing pressed or sintered powders. Conventional technologies have utilized pressed or sintered powders that consist of metals, metal oxides, and polymeric materials. Conventional frangible projectiles, however, due to their brittle composition, sometimes break apart before reaching a target when fired at higher velocities, including within the barrel of the firearm. Furthermore, conventional frangible projectiles are unable to survive aggressive rifling when being fired out of a barrel with a rifled bore while maintaining its ability to pulverize into fine particulates upon impact with a target, again breaking apart before the projectile reaches the target.

Accordingly, tools and techniques for creating a melt-castable (referred to herein as "castable" for brevity) frangible projectile are provided.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

Figure 1A:
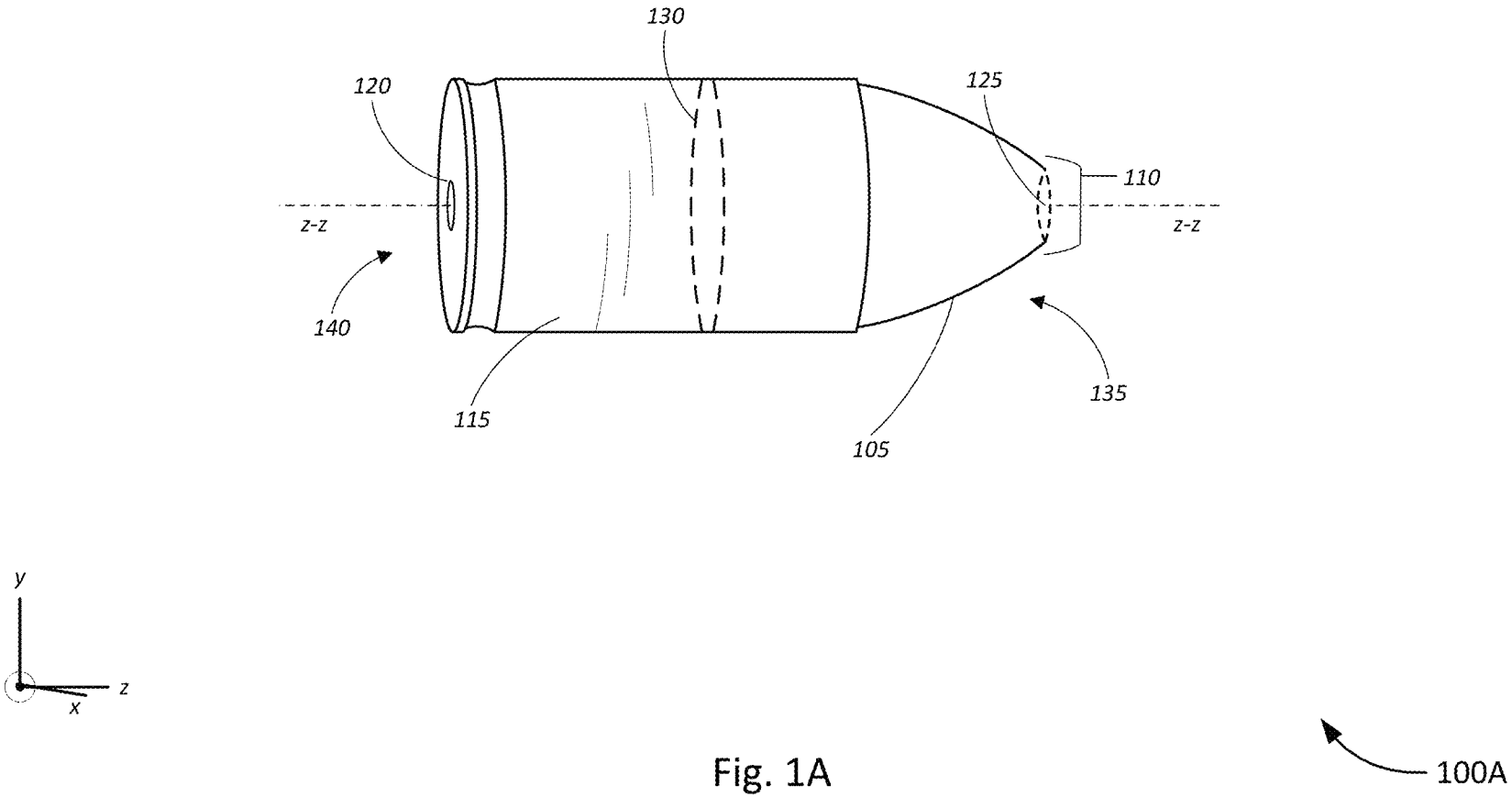
FIG. 1A is a schematic side perspective view of a castable frangible projectile small arms cartridge, in accordance with various embodiments.

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In an aspect, a cartridge system is provided. The cartridge system includes a case defining a volume, a propellant disposed in the volume of the case, and a projectile coupled to the case. The projectile may comprise a body further comprising a base disposed at a distal end of the body and a nose disposed at a proximal end of the body. The base of the body may be disposed at least partially within the case and configured to enclose the propellant within the volume of the case. A longitudinal axis of the body may be defined by an axis between the distal end and the proximal end, and the nose may be tapered to have a smaller circumference than the base. The body may be formed of a castable eutectic mixture, the castable eutectic mixture configured to be melted and cast, and the body may be configured to break into a plurality of fragments upon impact with a target.

In another aspect, a projectile is provided. The projectile includes a body comprising a base disposed at a distal end of the body and a nose disposed at a proximal end of the body, wherein a longitudinal axis of the body is defined by an axis between the distal end and the proximal end, wherein the nose is tapered to have a smaller circumference than the base. The body may be formed of a castable eutectic mixture, the castable eutectic mixture configured to be melted and cast, and the body may be configured to break into a plurality of fragments upon impact with a target In a further aspect, a method of manufacturing a castable frangible projectile is provided. The method includes blending a castable eutectic mixture, the castable eutectic mixture comprising at least bismuth, tin, and lead, wherein the castable eutectic mixture is between 50-100% bismuth by mass, 0-50% tin by mass, and 0-25% lead by mass, and heating the castable eutectic mixture to a first melting point, wherein each of the bismuth, tin, and lead are melted together, wherein the melting point is below a respective second melting point of any of the bismuth, tin, and lead individually. The method may further include casting a projectile from the castable eutectic mixture in its melted form, wherein the castable eutectic mixture is poured into a projectile mold, and cooling the projectile, wherein the projectile is configured to break into a plurality of fragments upon impact with a target.

Various modifications and additions can be made to the embodiments discussed without departing from the scope of the invention. For example, while the embodiments described above refer to particular features, the scope of this invention also includes embodiments having different combination of features and embodiments that do not include all of the above described features.

FIG. 1A is a schematic side perspective view of a castable frangible projectile small arms cartridge 100A, in accordance with various embodiments. The castable frangible projectile small arms cartridge 100A includes a castable frangible projectile 105 having a nose section 110, cavity 125, and base 130, casing 115, and primer 120. It should be noted that the various components of the castable frangible projectile small arms cartridge 100A (also referred to herein as "cartridge system" for brevity) are schematically illustrated in FIG. 1A, and that modifications to the cartridge system 100A may be possible in accordance with various embodiments.

In various embodiments, the castable frangible projectile 105 may include a nose 110 and base 130. The castable frangible projectile 105 may further include a nose cavity 125 located at the nose 110. The castable frangible projectile 105 may be coupled to the casing 115. In some embodiments, the castable frangible projectile 105 may be coupled to the casing 115 via a press-fit, crimping, or other method of mechanical coupling as known to those skilled in the art. As illustrated in FIG. 1A, the castable frangible projectile 105 may be positioned within the casing 115, such that at least part of the castable frangible projectile 105, including the base 130, is positioned inside the casing 115, the casing 115 creating a seal circumferentially around the body of the castable frangible projectile 105. Casing 115 may further include a primer 120 located at the base of the casing 115.

In various embodiments, the cartridge system 100A may be an elongated structure, having a proximal end 135 and distal end 140 defining a longitudinal axis z-z. Each of the casing 115 and castable frangible projectile 105 may further comprise a respective proximal end 135 and respective distal end 140 defining a respective longitudinal axis z-z of each of the casing 115 and castable frangible projectile 105. Thus, the body of the casing 115 and the body of the castable frangible projectile 105 may respectively be elongated in shape, and arranged collinearly along the longitudinal axis z-z.

In some embodiments, the casing 115 may be a brass casing that is cylindrical in shape, comprising an opening located at the proximal end 135, and base located at the distal end 140. The opening of the casing 115 may be configured to receive at least part of the castable frangible projectile 105, such that the distal end 140 of the castable frangible projectile 105 may be pressed into the opening of the casing 115 starting with the base 130 of the castable frangible projectile 105. Accordingly, in some embodiments, an inner diameter of the opening of the casing may be greater than an outer diameter of the base 130 of the castable frangible projectile 105. The casing 115 may further be configured to contain a propellant within a cavity defined between the base of the casing 115 and the base 130 of the castable frangible projectile 105. The propellant may include, without limitation, nitrocellulose, nitroglycerine, nitroguanidine, or other suitable gunpowder accelerant formulations, as known to those skilled in the art. The casing 115 may further include a primer 120 located at the base of the casing 115, and configured to initiate combustion of the propellant held within the casing 115. Accordingly, primer 120 may include, without limitation, impact-sensitive (e.g., a percussion primer) or other shock-sensitive, or electrically-activated primers, as known to those skilled in the art. Accordingly, in some embodiments, the base of the casing 115 may further include a rim, or alternatively, the base of the casing 115 may be rimless, as dependent on the respective form factor needed for a given firearm platform.

In various embodiments, the castable frangible projectile 105 may have an elongated body, cylindrical in shape at the base 130 at a distal end 140. The cylindrical shape may continue to some point between the base 130 and the nose 110. In some examples, the point may be a mid-point along the longitudinal axis z-z of the castable frangible projectile 105, centered between the base 130 and the nose 110. In some embodiments, the point may be located before the mid-point, closer to the distal end 140, or after the mid-point, closer to the proximal end 135. In various embodiments, the diameter of the castable frangible projectile 105 may taper in size from the point located between the base 130 and the nose 110 towards the nose 110. Thus, the body of the castable frangible projectile 105 may decrease in diameter, moving from the point towards the nose 110. Accordingly, in some embodiments, the nose 110 may be smaller in diameter than the base 130. The nose 110 may have a generally parabolic cross-sectional shape, while in other embodiments, the nose 110 may taper to a pointed tip, as in a spitzer bullet, as known to those skilled in the art. In some further embodiments, the nose 110 may include a cavity 125. The cavity 125 may be configured to cause fragmentation of at least the nose 110 of the castable frangible projectile 105, and to encourage further fragmentation of the body of the castable frangible projectile 105. In some embodiments, the cavity 125 may be configured such that stress from an impact is concentrated over a smaller surface area. In some embodiments, the cavity 125 may be created during casting of the castable frangible projectile 105, for example by utilizing a mold in which a cavity 125 is present in the nose 110. Alternatively, the cavity 125 of the castable frangible projectile 105 may be created in post-machining (e.g., after the casting process), for example, by drilling the cavity into the nose 110 of the castable frangible projectile 105. In some further embodiments, the cavity 125 may be filled, while in other embodiments, the cavity 125 may remain unfilled. For example, in some embodiments, the cavity 125 may be filled with a ballast material, which may be a granular powder-like material. Suitable ballast material may include, without limitation, steel, iron, carbon, titanium, zirconium, tantalum, molybdenum, tungsten, nickel, zinc, or aluminum. In further embodiments, the cavity 125 may be filled with a reactive material, as will be described in greater detail below, with respect to FIG. 5. Thus, in some embodiments, the cartridge system 100A may be a breaching round comprising a castable frangible projectile encapsulating a reactive material charge.

Similarly, in some embodiments, the base 130 or other part of the body of the castable frangible projectile 105, may further comprise a cavity (not shown), which may similarly be configured to encourage fragmentation of the castable frangible projectile 105 upon impact with a target. In some embodiments, the cavity may be an internal cavity inside the body of the castable frangible projectile 105. In other embodiments, the cavity may be created going into the body from an external surface of the body. Furthermore, like the cavity 125, the cavity at the base 130 or other part of the body of the castable frangible projectile 105 may further be filled with a ballast material, as described above, or with a reactive material, as will be described in greater detail below, with respect to FIG. 5.

Figure 1B:
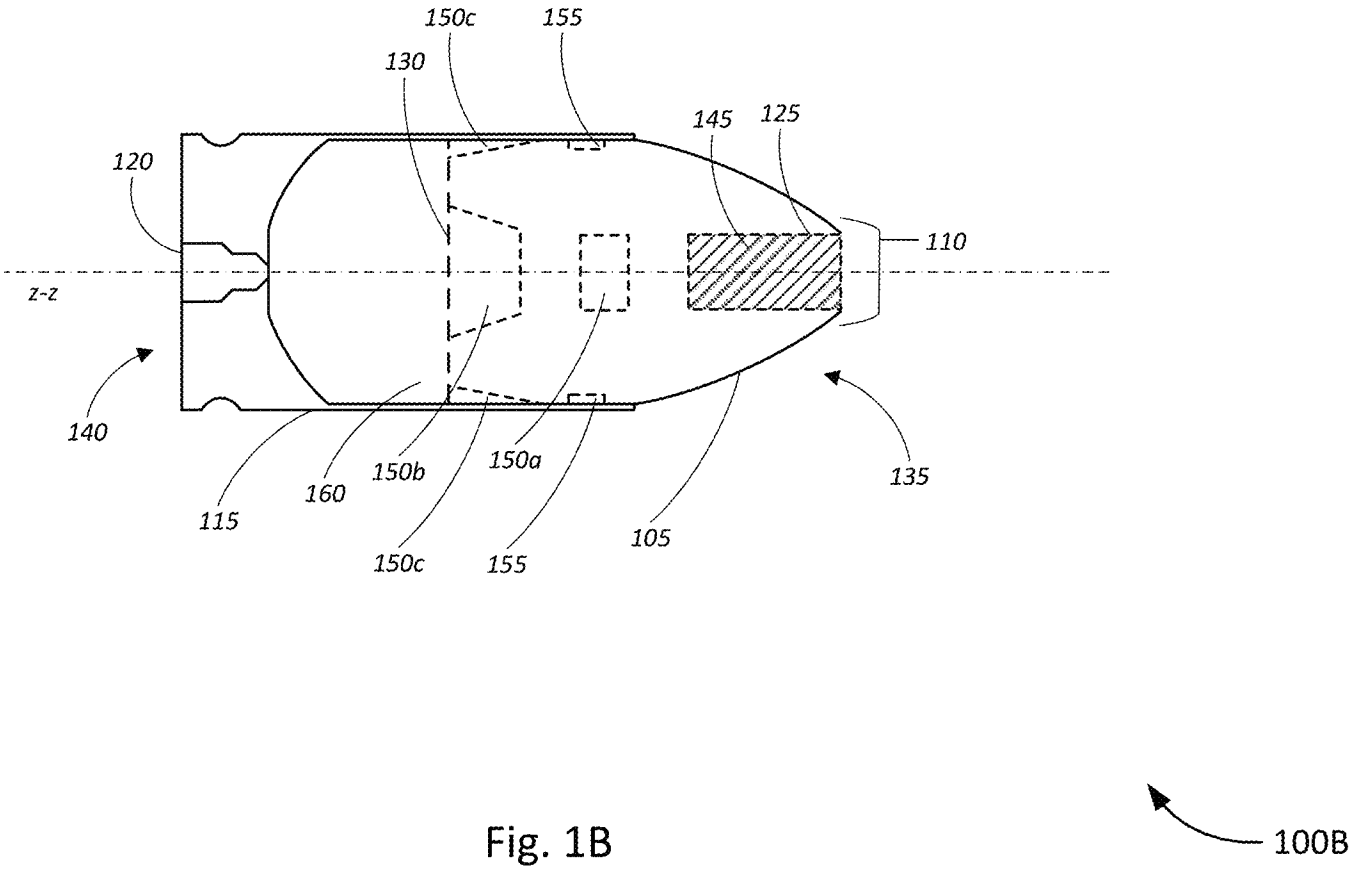
FIG. 1B is a schematic longitudinal section of the small arms cartridge, in accordance with various embodiments.

FIG. 1B is a schematic longitudinal section of the small arms cartridge 100B, in accordance with various embodiments. Accordingly, FIG. 1B schematically depicts internal components of the cartridge system 100B. The cartridge system 100B includes the castable frangible projectile 105 and the casing 115. A volume 160 may be defined between the base 130 of the castable frangible projectile 105 and the casing 115, which may be filled with a propellant as described above. The castable frangible projectile 105 may include a nose cavity 125 filled with filler material 145, an internal cavity 150*a*, a base cavity 150*b*, stress concentrator 150*c*, and one or more grooves 155. It should be noted that the various components of the cartridge system 100B are schematically illustrated in FIG. 1B, and that modifications to the cartridge system 100B may be possible in accordance with various embodiments.

In various embodiments, the castable frangible projectile 105 may be a one or more standard sizes for small arms projectiles. For example, in some embodiments, the size of the castable frangible projectile 105 may be scaled to various standard sizes, including, without limitation, handgun, rifle, and other small arms calibers and sizes. For example, the size of the castable frangible projectile may include, without limitation, .22 caliber, 5.7 mm (.224 caliber), 7.62 mm (.308 caliber), 9 mm, .357 caliber, .40 caliber, .44 caliber, .45 caliber, and .50 caliber. Similarly, the cartridge system 100A may include cartridges with projectiles of the corresponding size, such as, without limitation, .22 long rifle, 9×19 mm Parabellum, 5.56×45 mm NATO, .300 AAC blackout, .40 S&W, .45 ACP, among other cartridges as known to those skilled in the art. The castable frangible projectile may further be scaled to various sizes of shotgun ammunition, including, without limitation, 12-gauge, 20 gauge, 28 gauge, and .410 bore projectiles, as will be described with respect to FIGS. 2A & 2B. The castable frangible projectile 105 may further be scaled to the size of a 40 mm projectile, as described in greater detail with respect to FIGS. 3A & 3B. Thus, the castable frangible projectile 105 may be scaled to any size of projectile for a given application or platform.

In various embodiments, the castable frangible projectile 105 may be produced from a eutectic mixture, which may be a blend of metals, ceramics, composites, and other material powders. For example, in some embodiments, the composition of the castable frangible projectile 105 may be selected based on the manufacturability, ballistic performance, and frangibility of the projectile. In some embodiments, the eutectic mixture may comprise bismuth, tin, and lead, in its granular form that has been heated above its melting point such that all component materials are melted, well mixed, and cast into a desired projectile shape. In some embodiments, the eutectic mixture may comprise 50 to 100 percent bismuth by mass percentage, 0 to 50 percent tin by mass percentage, and 0 to 25 percent lead by mass percentage. In some embodiments, eutectic mixture may be a lead-free formulation.

Figure 4:
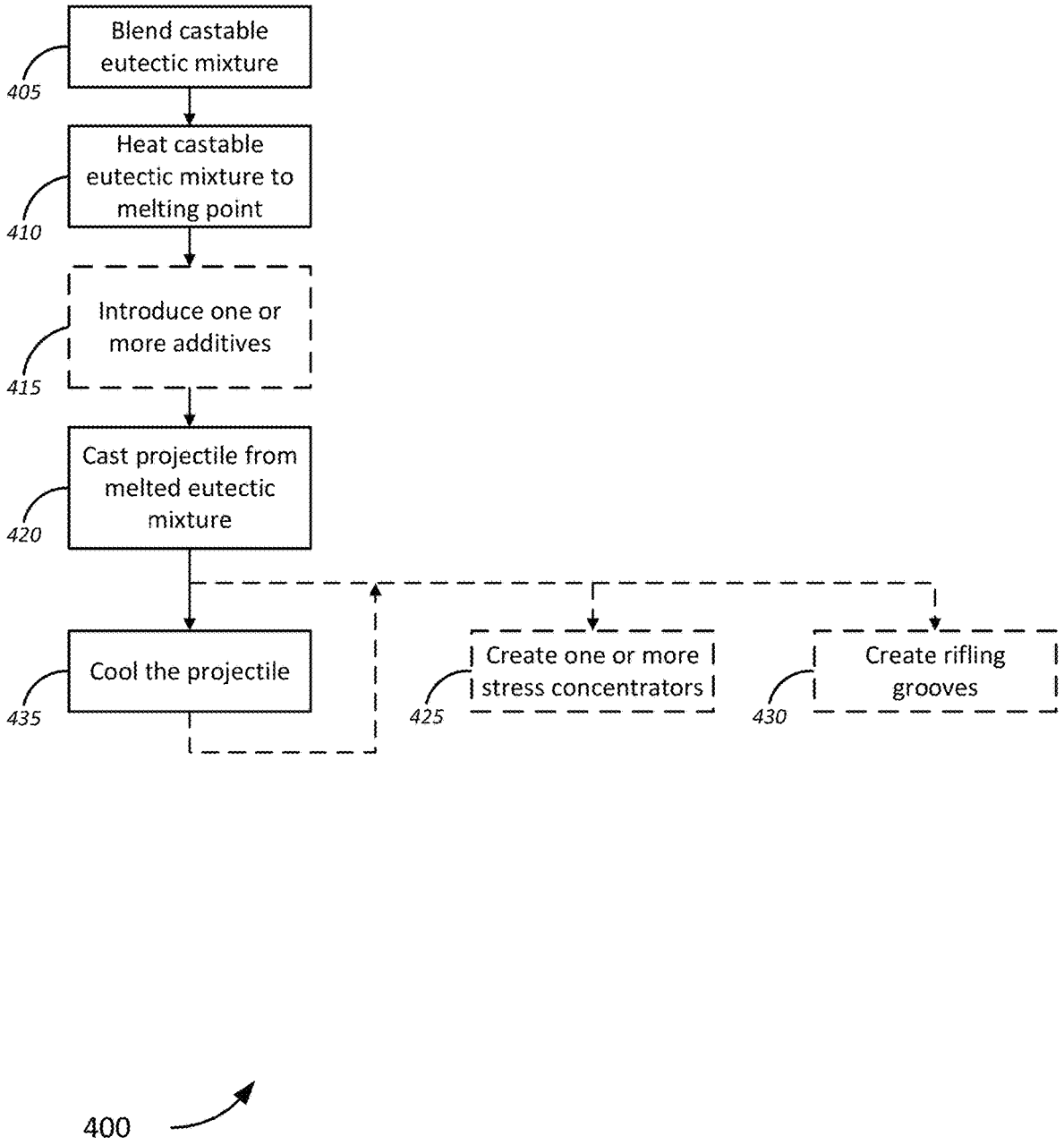
FIG. 4 is a flow diagram of a method of manufacturing a castable frangible projectile, in accordance with various embodiments.

In some embodiments, the frangibility of the castable frangible projectile 105 may be modified as discussed in further detail with respect to FIG. 4. In one example, the addition of one or more additives (e.g., high density, high melting materials) during the melting process may be utilized to alter the frangibility characteristics of the castable frangible projectile 105. For example, the one or more additives may include metals, ceramics, composite, and other materials added during the melt to encourage frangibility of the castable frangible projectile 105. The one or more additives may include, without limitation, steel, iron, carbon, titanium, zirconium, tantalum, molybdenum, tungsten, nickel, zinc, copper, aluminum, titanium oxide, molybdenum trioxide, molybdenum sulfide, tungsten trioxide, iron oxide, copper oxide, alumina, and silica.

In some embodiments, the castable frangible projectile 105 may be cast to further exhibit a ductility to survive engraving of rifling into the castable frangible projectile 105. For example, in some embodiments, the castable frangible projectile 105 may be fired out of a rifled bore. Thus, the rifling in the bore may cause rifling striations or grooves to be engraved into the body of castable frangible projectile 105 as it travels down the rifled bore at high pressures and/or high velocities. Accordingly, the castable frangible projectile 105 is configured to be ductile enough to survive engraving caused by a rifled bore, while maintaining its ability to fragment upon impact with a target. Thus, in various embodiments, a mass percentage of tin and/or lead may be increased to increase the ductility of the castable frangible projectile 105, while balancing the frangibility of the castable frangible projectile 105 which decreases with higher percentage mass of tin and/or lead.

In further embodiments, the castable frangible projectile 105 may include one or more grooves 155 engraved into the body of the castable frangible projectile 105 in post-machining after the castable frangible projectile 105 has been cast and cooled. For example, in some embodiments, one or more grooves 155 may be created in the body of the castable frangible projectile 105 to facilitate coupling with the casing 115. For example, the one or more grooves 155 may facilitate seating of the castable frangible projectile 105 to a proper depth inside the casing 115, and further to facilitate proper crimping of the casing 115 against the castable frangible projectile 105. In some embodiments, the one or more grooves 155 may be configured to facilitate formation of a seal by the casing 115 around the castable frangible projectile 105. In yet further embodiments, the one or more grooves 155 may include one or more rifling grooves for firing of the castable frangible projectile 105 through, for example, a smoothbore. Thus, the one or more rifling grooves may be configured to encourage rotation of the castable frangible projectile as it travels down a smoothbore. The one or more grooves 155 may, in some examples, include one or more concentric grooves, one or more longitudinal grooves, one or more helical grooves, or other projectile rifling pattern as known to those skilled in the art.

In various embodiments, the castable frangible projectile 105 may further include one or more stress concentrators, such as the nose cavity 125, one or more internal cavity 150*a*, base cavity 150*b*, and stress concentrator 150*c*. In various embodiments, the one or more stress concentrators may create higher density and/or lower density regions in the body of the castable frangible projectile 105. For example, in some embodiments, one or more of the nose cavity 125, one or more internal cavity 150*a*, base cavity 150*b*, and stress concentrators 150*c* may be filled with a granular ballast material. In some embodiments, the granular ballast material may be a higher density material than the eutectic mixture utilized to create the body of the castable frangible projectile 105. In other embodiments, the granular ballast material may be a lower density material than the eutectic mixture utilized to create the body of the castable frangible projectile 105. In further embodiments, the one or more stress concentrators may be empty cavities. As previously described, the ballast materials may include, without limitation, a granular powder-like material. Suitable ballast material may include, without limitation, steel, iron, carbon, titanium, zirconium, tantalum, molybdenum, tungsten, nickel, zinc, or aluminum. In further embodiments, one or more stress concentrators, such as the nose cavity 125 or internal cavity 150*a*, may be filled with a reactive material, as will be described in greater detail below, with respect to FIG. 5. In some embodiments, the one or more stress concentrators may be sealed with a sealing material. Sealing materials may include, without limitation, a polymeric material filling and/or coating, epoxy filling and/or coating, wax, or other suitable polymeric material or adhesive.

Stress concentrators 150*c*, in addition to cavities such as nose cavity 125, internal cavity 150*a*, or base cavity 150*b*, may further include material that has been removed from the body so as to direct stresses towards specific parts or in specific direction within the body of the castable frangible projectile 105. Stress concentrators, such as stress concentrator 150*c*, may create specific weak points within the body of the castable frangible projectile 105 at desired locations, such as locations that are relatively more resistant to fragmentation compared to other parts of the castable frangible projectile 105. For example, a nose 110 with nose cavity 125 may be more frangible than a base of the castable frangible projectile. Thus, by removing material via the creation of stress concentrators 150*c*, the stress concentrator 150*c* may encourage fragmentation of the distal end 140 of the castable frangible projectile 105. The stress concentrators 150*c* may further be configured to encourage fragmentation along specific features of the castable frangible projectile 105, for example by encouraging initial fragmentation into two or more fragments upon impact with a target prior to further fragmentation of each of the two or more fragments following the initial fragmentation. Thus, in some embodiments, the stress concentrators 150*c* may define weak points, contours, or lines, similar to fault lines, along which the body of the castable frangible projectile 105 may initially fragment to form two or more discrete fragments. The two or more discrete fragments may, subsequently, fragment further into a plurality of smaller granules.

Figure 2A:
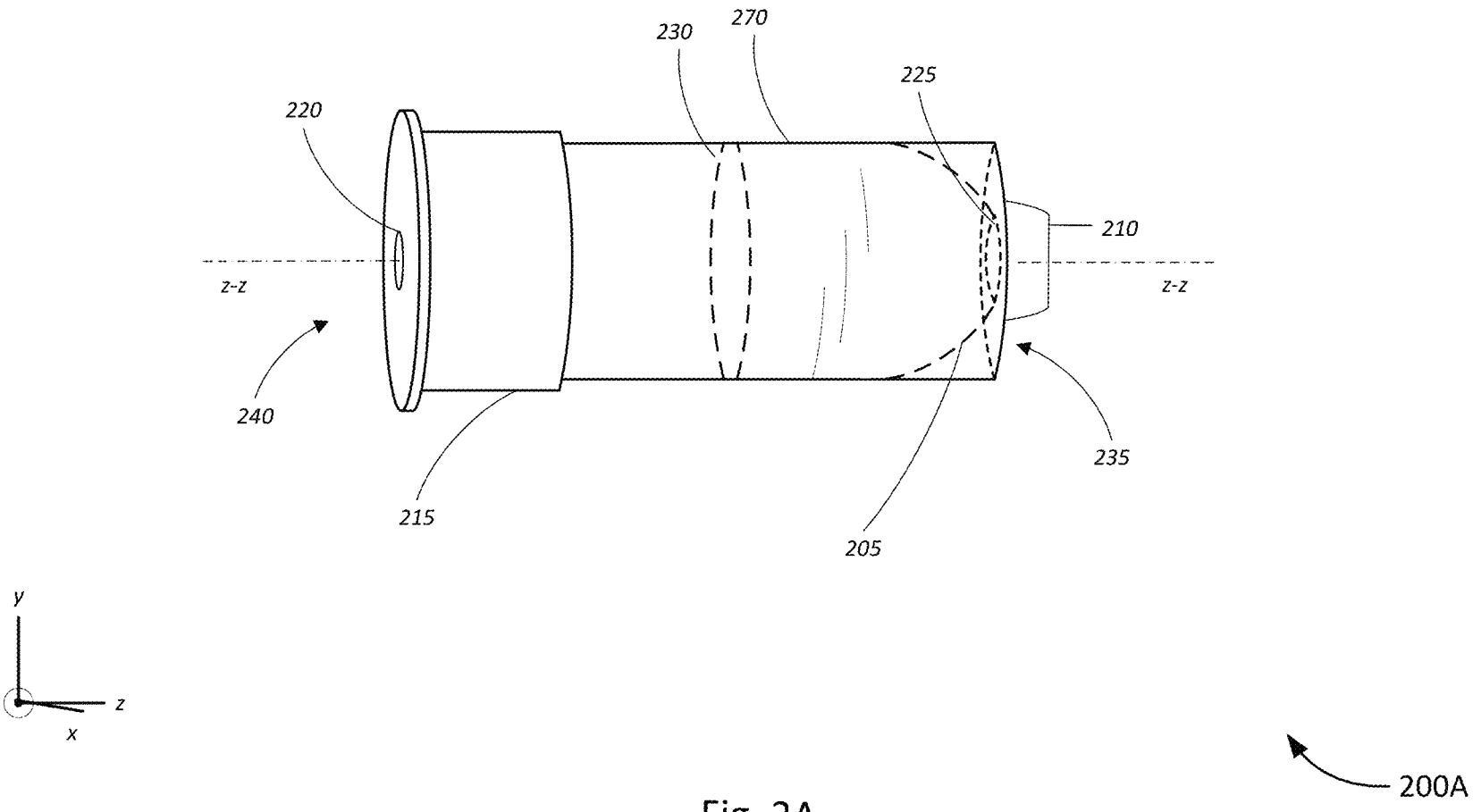
FIG. 2A is a schematic side perspective view of a castable frangible projectile shotgun shell, in accordance with various embodiments.

FIG. 2A is a schematic side perspective view of a castable frangible projectile shotgun shell 200A, in accordance with various embodiments. The castable frangible projectile shotgun shell 200A includes a castable frangible projectile 205 having a nose section 210, nose cavity 225, and base 230, case 270, brass head 215, and primer 220. It should be noted that the various components of the castable frangible projectile shotgun shell 200A (also referred to herein as a "cartridge system") are schematically illustrated in FIG. 2A, and that modifications to the cartridge system 200A may be possible in accordance with various embodiments.

In various embodiments, the castable frangible projectile 205 may include a nose 210 and base 230. The castable frangible projectile 205 may further include a nose cavity 225 located at the nose 210. The castable frangible projectile 205 may be disposed inside the case 270 and/or brass head 215. In some embodiments, the castable frangible projectile 205 may be contained within the case 270, or alternatively, coupled to the brass head 215 via a press-fit, crimping, or other method of mechanical coupling as known to those skilled in the art. As illustrated in FIG. 2A, the castable frangible projectile 205 may be fully encased within the case 270, the case 270 sealing the entirety of the castable frangible projectile 205. Brass head 215 may further include a primer 220 located at the rim of the brass head 215.

In various embodiments, as previously described with respect to FIG. 1A, the cartridge system 200A may be an elongated structure, having a proximal end 235 and distal end 240 defining a longitudinal axis z-z. Each of the case 270, brass head 215, and castable frangible projectile 205 may further comprise a respective proximal end 235 and respective distal end 240 defining a respective longitudinal axis z-z. Each of the body of the case 270, brass head 215, and the body of the castable frangible projectile 205 may respectively be elongated in shape, and arranged collinearly along the longitudinal axis z-z.

In various embodiments, the case 270 may be a substantially cylindrical structure. Similarly, the brass head 215 also be cylindrical in shape. In some embodiments, the brass head 215 may further include a rim at its base. The brass head 215 may include an opening located at a proximal end 235, configured to receive the case 270 and a powder charge. The case 270 may comprise an inner volume and an opening at its distal end 240. The case 270 may be configured to be inserted, from a distal end, into the opening of the brass head 215. The case 270 may be configured to contain, in its inner volume, the castable frangible projectile 205, wadding 260 (not shown), and at least part of the powder charge. Accordingly, the brass head 215 and/or the case 270 may further be configured to contain the powder charge within a cavity defined between the base of the brass head 215 and the base of the wadding in the case 270. The powder charge may include propellant may include, without limitation, nitrocellulose, nitroglycerine, nitroguanidine, or other suitable gunpowder accelerant formulations, as known to those skilled in the art. The brass head 215 may further include a primer 220 located at the base of the brass head 215, and configured to initiate combustion of the propellant held within the brass head 215. Accordingly, primer 220 may include, without limitation, impact-sensitive (e.g., a percussion primer) or other shock-sensitive, or electrically-activated primers, as known to those skilled in the art.

In some embodiments, castable frangible projectile 205 may be a 12-gauge projectile. In other embodiments, the castable frangible projectile 205 may be other sizes of projectile, including, without limitation, a 20 gauge, 28 gauge, or .410 bore projectile. Thus, the castable frangible projectile 205 may have an elongated body, cylindrical in shape at the base 230 at a distal end 240. The cylindrical shape may continue to some point between the base 230 and the nose 210. In some examples, the point may be a mid-point along the longitudinal axis z-z of the castable frangible projectile 205, centered between the base 230 and the nose 210. In some embodiments, the point may be located before the mid-point, closer to the distal end 240, or after the mid-point, closer to the proximal end 235. As previously described, in various embodiments, the diameter of the castable frangible projectile 205 may taper in size, starting from the point located between the base 230 and the nose 210, and moving towards the nose 210. Thus, the body of the castable frangible projectile 205 may decrease in diameter, moving from the point towards the nose 210.

As with the castable frangible projectile of the cartridge system 100A, the nose 210 of the castable frangible projectile 205 may have a generally parabolic cross-sectional shape, while in other embodiments, the nose 210 may taper to a pointed tip, as in a sabot projectile or spitzer bullet. In some further embodiments, the nose 210 may include a cavity 225. The cavity 225 may be configured to cause fragmentation of at least the nose 210 of the castable frangible projectile 205 upon impact with a target, and to encourage further fragmentation of the body of the castable frangible projectile 205.

Accordingly, in various embodiments, the castable frangible projectile 205 may be a monolithic slug in the castable frangible projectile shell 200A. In other embodiments, the castable frangible projectile shell 200A may include a plurality of shot pellets. Each of the shot pellets may individually be a castable frangible projectile 205 as described herein. Size of shot may include, without limitation, any size of buckshot, waterfowl shot, birdshot, clay shot, or pest shot, as known to those skilled in the art.

Figure 2B:
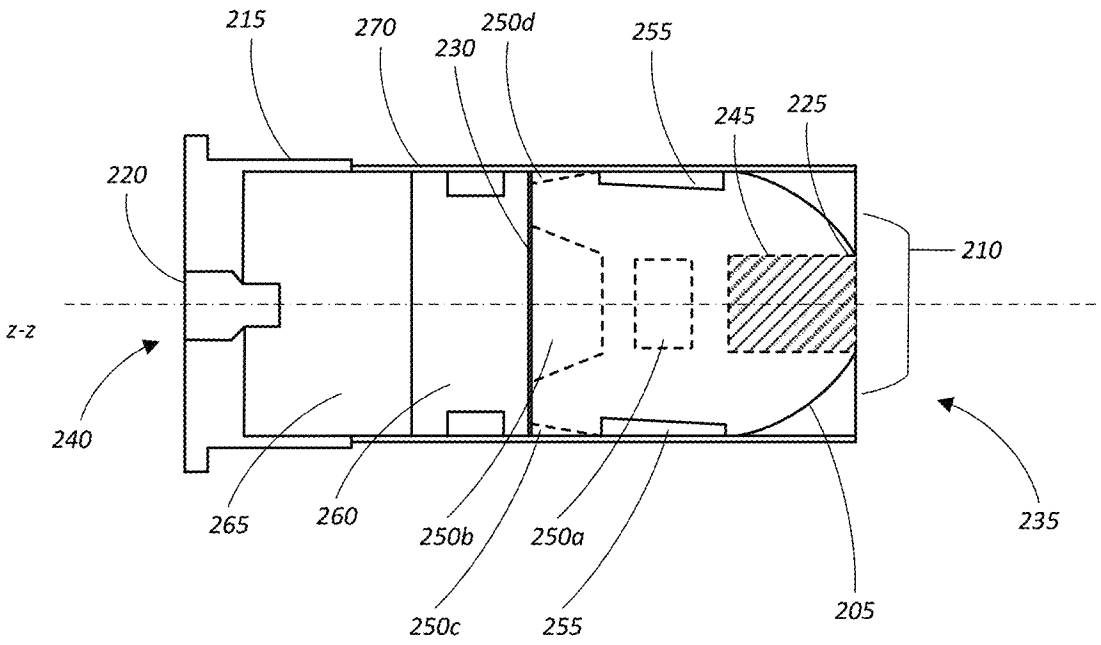
FIG. 2B is a schematic longitudinal section of the castable frangible projectile shotgun shell, in accordance with various embodiments.

FIG. 2B is a schematic longitudinal section of the castable frangible projectile shotgun shell 200B, in accordance with various embodiments. Accordingly, FIG. 2B schematically depicts internal components of the cartridge system 200B. The cartridge system 200B includes the castable frangible projectile 205, wadding 260, case 270, and brass head 215. A volume 265 may be defined between the base of the wadding 260 and the base of the brass head 215. The volume 265 may be filled with a propellant as described above. The castable frangible projectile 205 may include a nose cavity 225 filled with filler material 245, an internal cavity 250*a*, a base cavity 250*b*, stress concentrator 250*c*, and one or more grooves 255. It should be noted that the various components of the cartridge system 200B are schematically illustrated in FIG. 2B, and that modifications to the cartridge system 200B may be possible in accordance with various embodiments.

In various embodiments, the castable frangible projectile 205 may be scaled to various sizes of shotgun ammunition, including, without limitation, 12-gauge, 20 gauge, 28 gauge, and .410 bore projectiles, as described above. As previously described, the castable frangible projectile 205 may be produced from a eutectic mixture, which may be a blend of metals, ceramics, composites, and other material powders. In some embodiments, the eutectic mixture may comprise bismuth, tin, and lead, in its granular form that has been heated above a melting point of the eutectic mixture, such that all component materials are melted, well mixed, and cast into a desired projectile shape. In some embodiments, the melting point may be a first temperature that is lower than a melting point of any of the component materials individually. In some embodiments, the eutectic mixture may comprise 50 to 100 percent bismuth by mass percentage, 0 to 50 percent tin by mass percentage, and 0 to 25 percent lead by mass percentage. In some embodiments, eutectic mixture may be a lead-free formulation.

As previously described, in some embodiments, the frangibility of the castable frangible projectile 205 may be modified with the addition of one or more additives (e.g., high density, high melting materials) during the melting process to further improve the frangibility characteristics of the castable frangible projectile 205. For example, the one or more additives may include metals, ceramics, composite, and other materials added during the melt to encourage frangibility of the castable frangible projectile 105. The one or more additives may include, without limitation, steel, iron, carbon, titanium, zirconium, tantalum, molybdenum, tungsten, nickel, zinc, copper, aluminum, titanium oxide, molybdenum trioxide, molybdenum sulfide, tungsten trioxide, iron oxide, copper oxide, alumina, and silica.

The castable frangible projectile 205 may also be cast to further exhibit a ductility to survive engraving of rifling grooves, such as one or more grooves 255, into the castable frangible projectile 205. For example, most shotgun bores are smoothbores. Thus, the castable frangible projectile 205 may have one or more grooves 255 engraved into its body via post-machining, or alternatively, the castable frangible projectile may be cast utilizing a mold exhibiting the one or more grooves 255. The one or more grooves 255 may, in some examples, include one or more concentric grooves, one or more longitudinal grooves, one or more angled grooves, one or more helical grooves, or other projectile rifling pattern as known to those skilled in the art.

In various embodiments, the castable frangible projectile 205 may further include one or more stress concentrators, such as the nose cavity 225, one or more internal cavity 250*a*, base cavity 250*b*, and stress concentrator 250*c*. In various embodiments, the one or more stress concentrators may create higher density and/or lower density regions in the body of the castable frangible projectile 205. For example, in some embodiments, one or more of the nose cavity 225, one or more internal cavity 250*a*, base cavity 250*b*, and stress concentrators 250*c* may be filled with a granular ballast material. In some embodiments, the granular ballast material may be a higher density material than the eutectic mixture utilized to create the body of the castable frangible projectile 205. In other embodiments, the granular ballast material may be a lower density material than the eutectic mixture utilized to create the body of the castable frangible projectile 205. In further embodiments, the one or more stress concentrators may be empty cavities. As previously described, the ballast materials may include, without limitation, a granular powder-like material. Suitable ballast material may include, without limitation, steel, iron, carbon, titanium, zirconium, tantalum, molybdenum, tungsten, nickel, zinc, or aluminum. In further embodiments, one or more stress concentrators, such as the nose cavity 225 or internal cavity 250*a*, may be filled with a reactive material, as will be described in greater detail below, with respect to FIG. 5. Thus, in some embodiments, the cartridge system 200A, 200B may be a breaching round comprising a castable frangible projectile encapsulating a reactive material charge. In some embodiments, the one or more stress concentrators may be sealed with a sealing material. Sealing materials may include, without limitation, a polymeric material filling and/or coating, epoxy filling and/or coating, wax, or other suitable polymeric material or adhesive.

Stress concentrators 250*c*, in addition to cavities such as nose cavity 225, internal cavity 250*a*, or base cavity 250*b*, may further include material that has been removed from the body so as to direct impact stresses towards specific parts or in specific direction within the body of the castable frangible projectile 205. Stress concentrators, such as stress concentrator 250*c*, may create weak points within the body of the castable frangible projectile 205 at desired locations, such as locations that are relatively more resistant to fragmentation compared to other parts of the castable frangible projectile 205. The stress concentrators 250*c* may further be configured to encourage initial fragmentation of the castable frangible projectile 205 into two or more fragments upon impact with a target prior to further fragmentation of each of the two or more fragments following the initial fragmentation. Thus, in some embodiments, the stress concentrators 250*c* may define weak points, contours, or lines, similar to fault lines, along which the body of the castable frangible projectile 205 may initially fragment to form two or more discrete fragments. The two or more discrete fragments may, subsequently, fragment further into a plurality of smaller granules.

In various embodiments, the cartridge system 200B may include a plurality of shot pellets, each of shot pellet of the plurality of shot pellets a respective castable frangible projectile 205. In such embodiments, each respective castable frangible projectile 205 may be spherical in shape, like a ball. The plurality of shot pellets may be disposed in a cup of the wad 260. The wad 260 may, accordingly, include a cup structurally incorporated into the wad disposed at the proximal end of the wad 260. The cup may be configured to hold the plurality of shot pellets within the case 270.

Figure 3A:
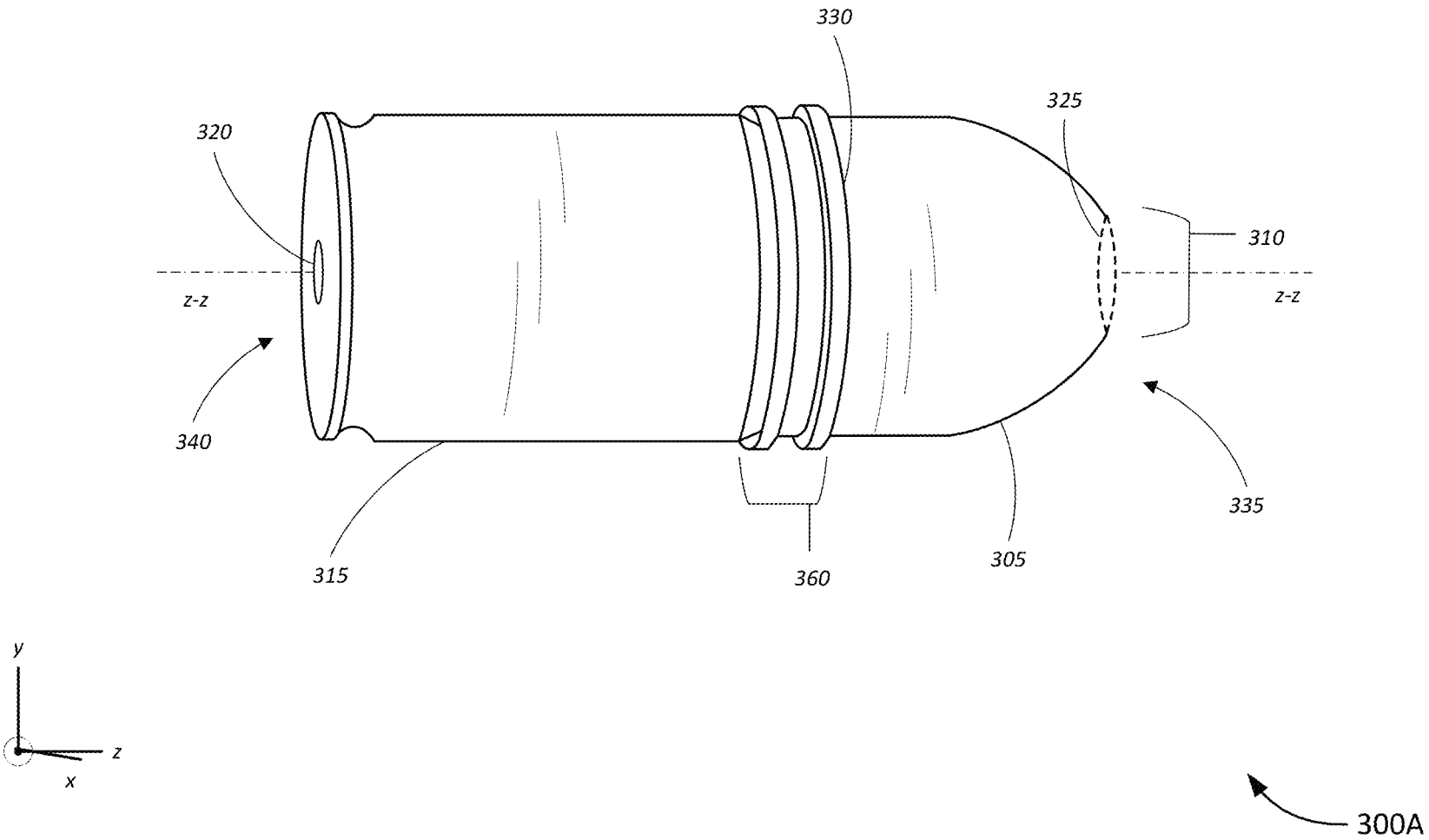
FIG. 3A is a schematic side perspective view of a castable frangible projectile 40 mm round, in accordance with various embodiments.

FIG. 3A is a schematic side perspective view of a castable frangible projectile 40 mm round 300A, in accordance with various embodiments. The castable frangible projectile 40 mm round 300A includes a castable frangible projectile 305 having a nose section 310, nose cavity 325, and base 330, casing 315, rotating band 360, and primer 320. It should be noted that the various components of the castable frangible projectile 40 mm round 300A (also referred to herein as a "cartridge system") are schematically illustrated in FIG. 3A, and that modifications to the cartridge system 300A may be possible in accordance with various embodiments.

In various embodiments, the castable frangible projectile 305 may include a nose 310 and base 330. The castable frangible projectile 305 may further include a nose cavity 325 located at the nose 310. The castable frangible projectile 205 may be disposed inside the casing 315. In some embodiments, the castable frangible projectile 305 may be coupled to the casing. In various embodiments, the casing 315 may be crimped, press-fit, or otherwise mechanically coupled to the castable frangible projectile 305. In some further embodiments, the rotating band 360 may be configured to be coupled to the casing 315, and further to coupled the castable frangible projectile 305 to the casing 315. As illustrated in FIG. 3A, the castable frangible projectile 305 may be at least partially disposed within the casing 315. Casing 315 may further include a primer 320 located at a base of the casing 315.

In various embodiments, as previously described with respect to FIGS. 1A & 2A, the cartridge system 300A may be an elongated structure, having a proximal end 335 and distal end 340 defining a longitudinal axis z-z. The casing 315 and castable frangible projectile 305 may further comprise a respective proximal end 335 and respective distal end 340 defining a respective longitudinal axis z-z. The casing 315 and the body of the castable frangible projectile 205 may respectively be elongated in shape, and arranged collinearly along the longitudinal axis z-z.

In various embodiments, the casing 315 may be a substantially cylindrical structure. The casing 315 may include an opening located at a proximal end 335, configured to receive the base 330 of the castable frangible round 305. The casing 315 may be configured to contain, in an inner volume, at least part of the distal end 340 of the castable frangible projectile 305 including the base 330, and a propellant charge. Accordingly, the casing 315 may further be configured to contain the propellant charge within a volume defined between the base of the casing 315 and the base 330 of the castable frangible projectile 305. The propellant charge may include, without limitation, nitrocellulose, nitroglycerine, nitroguanidine, or other suitable gunpowder accelerant formulations, as known to those skilled in the art. The casing 315 may further comprise a primer 320, located at the base of the casing 315, which is configured to initiate combustion of the propellant charge in the casing 315. Accordingly, primer 320 may include, without limitation, impact-sensitive (e.g., a percussion primer) or other shock-sensitive, or electrically-activated primers, as known to those skilled in the art.

In some embodiments, castable frangible projectile 305 may be a 40 mm projectile (e.g., 40 mm in diameter). Thus, the castable frangible projectile 305 may have an elongated body, cylindrical in shape at the base 330 at a distal end 340. Like the castable frangible projectile 105 in FIG. 1A, the cylindrical shape may continue to some point between the base 330 and the nose 310. In some examples, the point may be a mid-point along the longitudinal axis z-z of the castable frangible projectile 305, centered between the base 330 and the nose 310. In some embodiments, the point may be located before the mid-point, closer to the distal end 340, or after the mid-point, closer to the proximal end 335. As previously described, in various embodiments, the diameter of the castable frangible projectile 305 may taper in size, starting from the point located between the base 330 and the nose 310, and moving towards the nose 310. Thus, the body of the castable frangible projectile 305 may decrease in diameter, moving from the point towards the nose 310.

As with the castable frangible projectile 105 of the cartridge system 100A, the nose 310 of the castable frangible projectile 305 may have a generally parabolic cross-sectional shape, while in other embodiments, the nose 310 may taper to a pointed tip, as in a sabot projectile or spitzer bullet. In some further embodiments, the nose 310 may include a cavity 325. The cavity 325 may be configured to cause fragmentation of at least the nose 310 of the castable frangible projectile 305 upon impact with a target, and to encourage further fragmentation of the body of the castable frangible projectile 305.

In various embodiments, the rotating band 360 may be configured to engage the rifling of a 40 mm projectile launcher tube, and thus cause rotation of the castable frangible projectile 305. The rotating band 360 may thus be a feature formed from the body of the castable frangible projectile 305, or may be a distinct structure that is coupled to the castable frangible projectile 305.

Figure 3B:
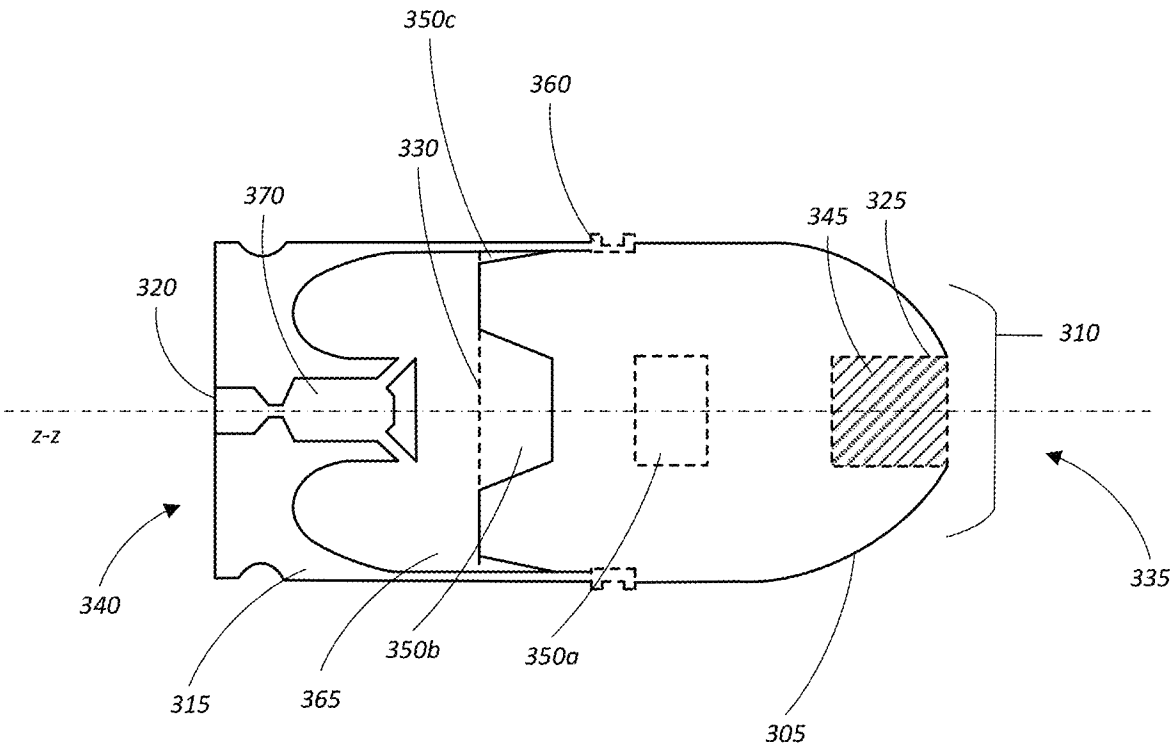
FIG. 3B is a schematic longitudinal section of the castable frangible projectile 40 mm round, in accordance with various embodiments.

FIG. 3B is a schematic longitudinal section of the castable frangible projectile 40 mm round 300B, in accordance with various embodiments. Accordingly, FIG. 3B schematically depicts internal components of the cartridge system 300B. The cartridge system 300B includes the castable frangible projectile 305, rotating band 360, and casing 315. The cartridge system 300B may further comprise a volume 365 defined between the base 330 of the castable frangible projectile 305 and the base of the casing 315. The volume 365 may be filled with a propellant as described above. The castable frangible projectile 305 may include a nose cavity 325 filled with filler material 345, an internal cavity 350*a*, a base cavity 350*b*, stress concentrator 350*c*, and rotating band 360. It should be noted that the various components of the cartridge system 300B are schematically illustrated in FIG. 3B, and that modifications to the cartridge system 300B may be possible in accordance with various embodiments.

As previously described, the castable frangible projectile 305 may be produced from a eutectic mixture, which may be a blend of metals, ceramics, composites, and other material powders. In some embodiments, the eutectic mixture may comprise bismuth, tin, and lead, in its granular form that has been heated above a melting point of the eutectic mixture, such that all component materials are melted, well mixed, and cast into a desired projectile shape. Like with the castable frangible projectiles 105, 205, the melting point of the eutectic mixture may be a first temperature that is lower than a melting point of any of the component materials individually. In some embodiments, the eutectic mixture may comprise 50 to 100 percent bismuth by mass percentage, 0 to 50 percent tin by mass percentage, and 0 to 25 percent lead by mass percentage. In some embodiments, eutectic mixture may be a lead-free formulation.

As previously described, in some embodiments, the frangibility of the castable frangible projectile 305 may be modified with the addition of one or more additives (e.g., high density, high melting materials) during the melting process to further improve the frangibility characteristics of the castable frangible projectile 305. For example, the one or more additives may include metals, ceramics, composite, and other aluminum, titanium oxide, molybdenum trioxide, molybdenum sulfide, tungsten trioxide, iron oxide, copper oxide, alumina, and silica.

In some embodiments, the castable frangible projectile 305 may also be cast to include rotating band 360, or alternatively, the rotating band may be created in post-machining. Alternatively, the rotating band 360 may be coupled to the castable frangible projectile 305 via mechanical coupling (e.g., press-fit) or thermal coupling (e.g., welding).

In various embodiments, the castable frangible projectile 305 may further include one or more stress concentrators, such as the nose cavity 325, one or more internal cavity 350*a*, base cavity 350*b*, and stress concentrator 350*c*. As previously described, in some embodiments, one or more of the nose cavity 325, one or more internal cavity 350*a*, base cavity 350*b*, and stress concentrators 350*c* may be filled with a granular ballast material. In some embodiments, the granular ballast material may be a higher density material than the eutectic mixture utilized to create the body of the castable frangible projectile 305. In other embodiments, the granular ballast material may be a lower density material than the eutectic mixture utilized to create the body of the castable frangible projectile 305. In further embodiments, the one or more stress concentrators may be empty cavities. As previously described, the ballast materials may include, without limitation, a granular powder-like material. Suitable ballast material may include, without limitation, steel, iron, carbon, titanium, zirconium, tantalum, molybdenum, tungsten, nickel, zinc, or aluminum. In further embodiments, one or more stress concentrators, such as the nose cavity 325 or internal cavity 350*a*, may be filled with a reactive material, as will be described in greater detail below, with respect to FIG. 5. Thus, in some embodiments, the cartridge system 300A, 300B may be a breaching round comprising a castable frangible projectile encapsulating a reactive material charge. In some embodiments, the one or more stress concentrators may be sealed with a sealing material. Sealing materials may include, without limitation, a polymeric material filling and/or coating, epoxy filling and/or coating, wax, or other suitable polymeric material or adhesive.

Stress concentrators 350*c*, in addition to cavities such as nose cavity 325, internal cavity 350*a*, or base cavity 350*b*, may further include material that has been removed from the body so as to direct impact stresses towards specific parts or in specific direction within the body of the castable frangible projectile 305. Stress concentrators, such as stress concentrator 350*c*, may create weak points within the body of the castable frangible projectile 305 to encourage fragmentation. The stress concentrators 250*c* may further be configured to encourage fragmentation along specific features of the castable frangible projectile 305, for example to encourage an initial fragmentation into two or more fragments upon impact with a target prior to further fragmentation of each of the two or more fragments following the initial fragmentation. Thus, in some embodiments, the stress concentrators 350*c* may define weak points, contours, or lines, similar to fault lines, along which the body of the castable frangible projectile 305 may initially fragment to form two or more discrete fragments. The two or more discrete fragments may, subsequently, fragment further into a plurality of smaller granules.

FIG. 4 is a flow diagram of a method 400 of manufacturing a castable frangible projectile, in accordance with various embodiments. The method 400 begins, at block 405, by blending a castable eutectic mixture. As described above, the castable eutectic mixture comprises a blend of metallic powders. In some embodiments, the castable eutectic mixture comprises a blend of bismuth, tin, and lead, or any combination thereof. Thus, the castable eutectic mixture may be a blended powder mixture of any combination of powdered bismuth, tin, and/or lead.

Accordingly, in some embodiments, the eutectic mixture may comprise 50 to 100 percent bismuth by mass (e.g., mass percentage), 0 to 50 percent tin by mass percentage, and 0 to 25 percent lead by mass percentage, where mass percentage is a calculation of the percentage by mass of a respective component (e.g., bismuth, tin, or lead) of the mixture. Put another way, it is the ratio of the mass of a respective component material to the total mass of the mixture. The mass percentage of a component material may be given by dividing the mass of the respective component material by the total mass of the mixture, multiplied by 100 to give a percentage.

In various embodiments, the composition of the eutectic mixture may be changed, based on the desired characteristics for the castable frangible projectile to be produced. For example, to increase a ductility of the castable frangible projectile, the eutectic mixture may comprise a higher mass percentage of tin and/or lead. In some embodiments, the castable eutectic mixture may comprise a lead-free blend of bismuth and tin. In some embodiments, a mass percentage of bismuth may be increased to increase the brittleness (and in turn the frangibility) of the castable frangible projectile.

The method 400 may continue, at block 410, by heating the castable eutectic mixture to a melting point of the eutectic mixture. The melting point may be a first temperature at which the eutectic mixture may melt into a liquid state. The first the castable eutectic mixture may be heated to or above the first temperature, which may be lower than a respective melting point of any component material individually. For example, the eutectic mixture of bismuth, tin, and/or lead may have a melting point at a first temperature. The melting point of bismuth may be a second temperature, higher than the first temperature. Similarly, the melting point of tin may be a third temperature, higher than the first temperature, and the melting point of lead may be a fourth temperature higher than the first temperature. For example, the eutectic mixture of bismuth, tin, and lead may have a melting point at a first temperature, which may be between 94-98 degrees Celsius, further depending on ambient pressure, and other environmental factors as known to those skilled in the art. The respective melting points of bismuth (Bi) (271.4 degrees Celsius), lead (Pb) (327.5 degrees Celsius), and tin (Sn) (231.9 degrees Celsius), are accordingly higher than that of the eutectic mixture. The eutectic mixture may, thus, be heated to a first temperature at or above the melting point of the eutectic mixture, creating a uniformly melted eutectic mixture. The eutectic mixture, in its molten form, may further be mixed to ensure a uniform blend of the component materials. In some embodiments, the eutectic mixture may be configured to maintain densities similar to conventional lead and copper projectiles. In some examples, the castable frangible projectile may be within +/−0-50% of the density of conventional lead and copper projectiles.

The method 400 continues, at block 415, by introducing one or more additives to the eutectic mixture during the melting process. For example, once the eutectic mixture has been heated to the first temperature, the one or more additives may be mixed into the molten eutectic mixture. The one or more additives may include high density and/or high melting point materials. In some embodiments, the one or more additives may include metallic, ceramic, and/or composite materials introduced during the melt to encourage frangibility. The one or more additives may include, without limitation, steel, iron, carbon, titanium, zirconium, tantalum, molybdenum, tungsten, nickel, zinc, copper, aluminum, titanium oxide, molybdenum trioxide, molybdenum sulfide, tungsten trioxide, iron oxide, copper oxide, alumina, and silica. In some embodiments, the one or more additives can range in size from 10 to 400 mesh.

Once the eutectic mixture has been heated above its melting point and is well mixed, at block 420, the method 400 may continue by casting a projectile from the melted eutectic mixture. For example, in various embodiments, the molten eutectic mixture may be cast into projectile molds. The projectile molds may include molds for projectiles of various sizes and with various features. As previously described, eutectic mixture may be cast into projectiles for various small arms, for example, by casting into molds configured to produce projectiles of various sizes, including, .22 caliber, 5.7 mm (.224 caliber), 7.62 mm (.308 caliber), 9 mm, .357 caliber, .40 caliber, .44 caliber, .45 caliber, and .50 caliber. The molds may further be configured to produce various sizes of shotgun projectiles, including, without limitation, 12-gauge, 20 gauge, 28 gauge, and .410 bore projectiles, including buckshot, waterfowl shot, birdshot, slugs, and sabot rounds. In further embodiments, the eutectic mixture may be cast into 40 mm projectiles, for example by casting into molds configured to produce 40 mm projectiles. Thus, the castable frangible projectile may be scaled to any size of projectile for a given application or platform.

At block 425, the method 400 may continue by creating one or more stress concentrators in the projectiles. The one or more stress concentrators may include one or more cavities in the nose, base, internally, and one or more stress concentrators. In various embodiments, the cavities in the projectiles may be created during the casting process. For example, the mold may be configured to include one or more cavities in the nose, base, or internally. The mold may further include features of the one or more stress concentrators, as described above. Alternatively, in some embodiments, the cavities and/or stress concentrators may be created in post-machining after the castable frangible projectile has been cooled, at step 435 described below. Post-machining may include drilling, engraving, or otherwise removing material from the castable frangible projectile after it has been cooled, to create the one or more cavities or stress concentrators.

Thus, the castable frangible projectile may be cast with a cavity and/or one or more stress concentrators, or the cavities and/or stress concentrators may be post-machined into the castable frangible projectile. In various embodiments, the one or more cavities may be created to have dimensions according to a desired specification. For example, the one or more cavities may be created to have a certain volume, specific depth, width, or length, to create a desired opening or other features.

In various embodiments, the one or more cavities may be empty, or alternatively filled with a ballast material, as previous described. Ballast material may include, without limitation, steel, iron, carbon, titanium, zirconium, tantalum, molybdenum, tungsten, nickel, zinc, or aluminum. Ballast material may be granular in form, ranging in size from 10 to 400 mesh. In some embodiments, ballast material may be configured to increase penetration of the castable frangible projectile. In further embodiments, the ballast material may be configured to also increase the frangibility of the castable frangible projectile.

Once filled with ballast material, the cavity may, in some embodiments, be filled and/or sealed with a polymeric material or adhesive, such as, without limitation, epoxy, wax, or other polymeric material. Filling and sealing of the cavities may, accordingly, be performed after casting and cooling of the castable frangible projectile, as described at block 435.

At block 430, the method 400 may further include creating rifling grooves in the castable frangible projectile. As with the one or more stress concentrators, rifling grooves may be created in the casting process or created in post-machining. In some embodiments, rifling grooves may include grooves created in the castable frangible projectile to encourage rotation (e.g., rifling) of the projectile as it travels through a bore/the air. Rifling grooves may include, without limitation, concentric grooves, slanted grooves, longitudinal grooves, helical grooves, or other rifling pattern as known to those skilled in the art.

In other embodiments, rifling grooves may be engraved into the body of the castable frangible projectile when it is fired out of a rifled bore as the castable frangible projectile travels down the rifled bore at high velocity and pressure. Thus, to ensure that the castable frangible projectile remains intact during the creation of rifling grooves, whether through post-machining or through engraving during firing of the castable frangible projectile, the castable frangible projectile may be configured to exhibit enough ductility to survive rifling without breaking apart in the barrel, or during post-machining. In further embodiments, the rifling grooves may include a feature of the frangible castable projectile configured to engage the rifling of a bore, such as, for example, a rotating band of a 40 mm projectile.

At block 435, once the castable frangible projectiles have been cast into respective molds, the hot castable frangible projectiles may be cooled. In some embodiments, the castable frangible projectiles may be quenched while still hot. Quenching may be performed in water, oil, or cooled air to achieve or otherwise maintain a desired crystalline structure, which may further encourage frangibility of the castable frangible projectile. In other embodiments, the castable frangible projectile may not be quenched, and instead allowed to cool in ambient temperature air. Thus, through the process of casting and cooling, a crystalline structure may be created in the body of the castable frangible projectile.

Figure 5:
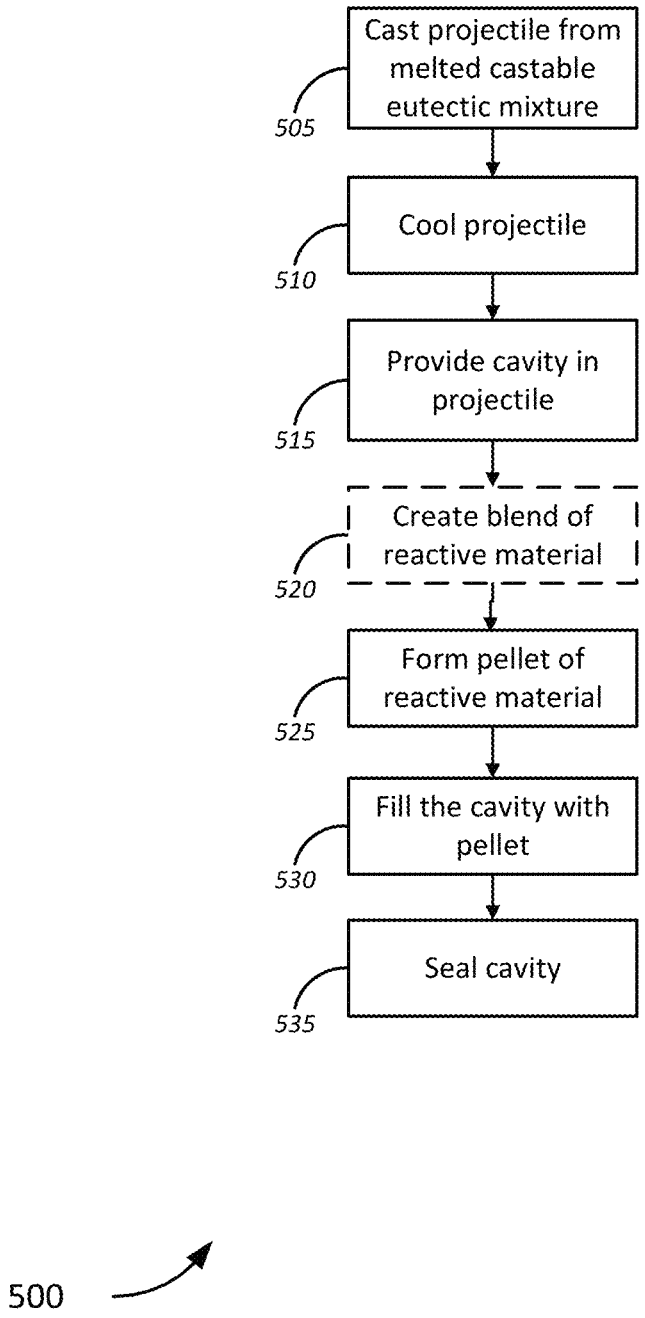
FIG. 5 is a flow diagram of a method of manufacturing an enhanced breaching round utilizing a castable frangible projectile, in accordance with various embodiments.

FIG. 5 is a flow diagram of a method 500 of manufacturing an enhanced breaching round utilizing a castable frangible projectile, in accordance with various embodiments. The method 500 begins, at block 505, by casting of the castable frangible projectile, as described above with respect to FIG. 4. As previously described, the castable frangible projectile may be cast from a eutectic mixture that has been melted by heating to a first temperature that is at or above the melting point of the eutectic mixture, but lower than a melting point of any respective component material of the eutectic mixture individually. The castable frangible projectile may be cast according to various standard sizes of projectile, including, without limitation, 22 caliber, 5.7 mm (.224 caliber), 7.62 mm (.308 caliber), 9 mm, .357 caliber, .40 caliber, .44 caliber, .45 caliber, and .50 caliber. The molds may further be configured to produce various sizes of shotgun projectiles, including, without limitation, 12-gauge, 20 gauge, 28 gauge, and .410 bore projectiles, including buckshot, waterfowl shot, birdshot, slugs, and sabot rounds. In further embodiments, the eutectic mixture may be cast into 40 mm projectiles, for example by casting into molds configured to produce 40 mm projectiles. Thus, the castable frangible projectile may be scaled to any size of projectile for a given application or platform.

In various embodiments, the eutectic material may be configured to maintain a similar density to conventional lead and/or copper projectiles. For example, in some embodiments, the castable frangible projectile may be configured to have a density that is within +/−50% of the density of conventional lead and/or copper ammunition.

Once the castable frangible projectile has been cast, the method 500 may continue, at block 510, with cooling of the castable frangible projectile. As previously described with respect to FIG. 4, cooling may include quenching of the castable frangible projectile while it is still hot. Quenching may be performed in water, oil, or cooled air to achieve or otherwise maintain a desired crystalline structure, which may further encourage frangibility of the castable frangible projectile. In other embodiments, the castable frangible projectile may not be quenched, and instead allowed to cool in ambient temperature air.

At block 515, the method 500 continues by providing one or more cavities in the castable frangible projectile. As described with respect to FIG. 4 above, the one or more cavities may be created in the castable frangible projectile during casting (e.g., by using a mold configured to create the one or more cavities), or by post-machining of the cavities (e.g., drilling, engraving, etc.).

The one or more cavities may include cavities in the nose, base, or an internal cavity. In various embodiments, the one or more cavities may be created to have dimensions according to a desired specification. For example, the one or more cavities may be created to have a certain volume, specific depth, width, or length, to create a desired opening or other features.

In various embodiments, some of the one or more cavities may be empty, or alternatively filled with a ballast material, as previous described. Ballast material may include, without limitation, steel, iron, carbon, titanium, zirconium, tantalum, molybdenum, tungsten, nickel, zinc, or aluminum. Ballast material may be granular in form, ranging in size from 10 to 400 mesh. In some embodiments, ballast material may be configured to increase penetration of the castable frangible projectile. In further embodiments, the ballast material may be configured to also increase the frangibility of the castable frangible projectile.

Once filled with ballast material, the cavity may, in some embodiments, be filled and/or sealed with a polymeric material or adhesive, such as, without limitation, epoxy, wax, or other polymeric material. Filling and sealing of the cavities may, accordingly, be performed after casting and cooling of the castable frangible projectile, as described at block 535.

The method 500 continues, at block 520, by creating a blend of reactive material. In various embodiments, the reactive material may comprise at least one oxidizer, at least one fuel, and no binder. In various embodiments, the reactive material may be configured to be a low-smoke formulation. For example, the reactive material may be configured to use a fuel having a low flame temperature.

In various embodiments, the at least one oxidizer may include at least one of ammonium perchlorate, ammonium nitrate, potassium nitrate, potassium perchlorate, potassium chlorate, lithium perchlorate, or ceric ammonium nitrate. The at least one fuel may include at least one of guanidine nitrate, nitroguanadine, 5-amino tetrazole, or nitrocellulose.

In various embodiments, the at least one oxidizer and the at least one fuel may be powdered in form. Particle sizes for the at least one oxidizer and the at least one fuel may range from 40 mesh to 400 mesh. For example, in some embodiments, particles may vary in size within the range of 40-400 mesh, or fall within a subrange of sizes within the range of 40-400 mesh. In other embodiments, the particles may be the same size, but fall within the range of 40-400 mesh, or may comprise a set of one or more particle sizes within the range of 40-400 mesh.

In various embodiments, the mass percentages of the at least one oxidizer and at least one fuel may vary depending on the type of oxidizer and type of fuel used. For example, in some embodiments, for the at least one oxidizer, the reactive material may be 0 to 55% ammonium perchlorate by mass (e.g., mass percentage), 0 to 55% ammonium nitrate by mass percentage, 0 to 45% potassium nitrate by mass percentage, 0 to 50% potassium perchlorate by mass percentage, 0 to 55% potassium chlorate by mass percentage, 0 to 45% lithium perchlorate by mass percentage, and 0 to 45% ceric ammonium nitrate by mass percentage.

The reactive material may, in further embodiments, for the at least one fuel, comprise 0 to 60% guanidine nitrate by mass (e.g., mass percentage), 0 to 60% nitroguanidine by mass percentage, 0 to 60% 5-amino tetrazole by mass percentage, and 0 to 60% nitrocellulose by mass percentage.

Accordingly, in various embodiments, the blend of reactive material may be created by blending, in powdered form, the mixture of the at least one oxidizer and at least one fuel in the mass percentages described above. In various embodiments, mixing may include physically stirring, sifting, milling, folding, or otherwise incorporating the powders of the at least one oxidizer with the powders of the at least one fuel.

In yet further embodiments, the reactive material may include at least one dense inert metal (DIM), as known to those skilled in the art, which may be blended with the at least one oxidizer and the at least one fuel. DIMs may include, without limitation, one or more types of metals, including at least one of steel, stainless steel, tungsten, tantalum, molybdenum, or iron. Like the at least one oxidizer and the at least one fuel, the DIM may be a powder (e.g., DIM powder). In various embodiments, DIM powder of different sizes may be utilized. Sizes may range from 100 mesh to 400 mesh granules. In various embodiments, the mass percentages of DIM powder in the reactive material may be 0 to 75%. In various embodiments, the DIM powder may be blended with the at least one oxidizer and at least one fuel via physical mixing, stirring, sifting, milling, folding, or otherwise incorporating the DIM powder with the at least one oxidizer and at least one fuel.

At block 525, the method 500 may continue by forming a pellet of reactive material. In various embodiments, once the reactive material has been blended, a pellet may be formed by pressing the blend of reactive material powders into a pellet. At block 530, the one or more cavities may be filled with the reactive material pellet. For example, the reactive material pellet may be inserted into one or more of the one or more cavities (e.g., nose, base, and/or internal). At block 535, the reactive material may be sealed in the cavity. Thus, in various embodiments, the pellet of reactive material may be encased in the castable frangible projectile, which may act as a frangible shell for delivering the reactive material pellet. As previously described with respect to the ballast materials, once the reactive material pellet has been placed in the one or more cavities, the one or more cavities may be sealed via a polymeric material or adhesive, such as, without limitation, epoxy, wax, or other polymeric material. In yet further embodiments, the reactive material may be sealed in a ceramic, metal, or composite material.

Accordingly, the castable frangible breaching round may include many advantages over traditional breaching ammunition. For example, traditional breaching rounds rely on the size and mass of a frangible projectile, which are typically fired out of smooth bore barrels, such as a shotgun. Thus, weapons with rifled bores or utilizing smaller caliber projectiles could not effectively be used to breach entryways. Conventional breaching rounds, which rely on the size and mass of a projectile to physically destroy a locking mechanism of a door, gate, or other entryway are unable to be scaled to different calibers and were limited in terms of effective weapon platforms.

By providing a castable frangible projectile with a reactive material charge (e.g., reactive material pellet) housed in one or more cavities, a smaller caliber projectile may be used to effectively breach a door, disrupting or destroying locking mechanisms of a door, gate, or other entryway through the explosive reaction caused upon impact of the reactive material charge with the target. Moreover, by utilizing a castable frangible projectile as described above, the castable frangible projectiles are further able to be fired out of various weapons platforms that utilize various sizes of projectile, rifled and smooth bore platforms, and with the ability to survive even aggressive rifling encountered by projectiles fired out of rifle cartridges.

While certain features and aspects have been described with respect to exemplary embodiments, one skilled in the art will recognize that numerous modifications are possible. For example, the methods and processes described herein may be implemented using various hardware, tools, and control components. Further, while various methods and processes described herein may be described with respect to certain structural and/or functional components for ease of description, methods provided by various embodiments are not limited to any single structural and/or functional architecture but instead can be implemented on any suitable hardware configuration. Similarly, while certain functionality is ascribed to certain system components, unless the context dictates otherwise, this functionality can be distributed among various other system components in accordance with the several embodiments.

Moreover, while the procedures of the methods and processes described herein are described sequentially for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a specific structural arrangement and/or with respect to one system may be organized in alternative structural arrangements and/or incorporated within other described systems. Hence, while various embodiments are described with—or without—certain features for ease of description and to illustrate exemplary aspects of those embodiments, the various components and/or features described herein with respect to one embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A method comprising:

blending a castable eutectic mixture, the castable eutectic mixture comprising at least bismuth, tin, and lead, wherein the castable eutectic mixture is at least 50% bismuth by mass, at most 50% tin by mass, and at most 25% lead by mass;

heating the castable eutectic mixture to a first melting point, wherein each of the bismuth, tin, and lead are melted together, wherein the melting point is below a respective second melting point of any of the bismuth, tin, and lead individually;

casting a projectile from the castable eutectic mixture in melted form, wherein the castable eutectic mixture is poured into a projectile mold; and cooling the projectile, wherein the projectile is configured to break into a plurality of fragments upon impact with a target.

2. The method of claim 1 further comprising:

introducing one or more additives to the castable eutectic mixture during the heating of the castable eutectic mixture to the melting point, the one or more additives configured to encourage frangibility of the body, wherein the one or more additives includes one or more of steel, iron, carbon, titanium, zirconium, tantalum, molybdenum, tungsten, nickel, zinc, copper, aluminum, titanium oxide, molybdenum trioxide, molybdenum sulfide, tungsten trioxide, iron oxide, copper oxide, alumina, and silica.

3. The method of claim 1 further comprising:

creating one or more rifling grooves circumferentially around a longitudinal axis of the projectile, each of the one or more rifling grooves circling around the projectile at least one time.

4. The method of claim 1 further comprising:

creating one or more cavities in at least one of a nose of the projectile or the base of the projectile, wherein the projectile comprises a proximal end and a distal end, the proximal end and the distal end defining a longitudinal of the projectile, and wherein the nose is disposed at the proximal end of the projectile, and the base is disposed at the distal end of the projectile.

* * * * *